US006334327B1

(12) United States Patent
Fujiwara

(10) Patent No.: US 6,334,327 B1
(45) Date of Patent: Jan. 1, 2002

(54) SNOWMAKING MACHINE

(75) Inventor: Takamasa Fujiwara, Hiroshima-ken (JP)

(73) Assignees: Koyo Industry Co., Ltd., Aki-gun; Piste Snow Industries Co., Ltd., Tokyo, both of (JP)

( * ) Notice: Subject to any disclaimer, the term of this patent is extended or adjusted under 35 U.S.C. 154(b) by 0 days.

(21) Appl. No.: 09/701,660

(22) PCT Filed: Dec. 8, 1999

(86) PCT No.: PCT/JP99/06892

§ 371 Date: Nov. 30, 2000

§ 102(e) Date: Nov. 30, 2000

(87) PCT Pub. No.: WO01/42725

PCT Pub. Date: Jun. 14, 2001

(51) Int. Cl.[7] ..... F25C 5/02
(52) U.S. Cl. ..... 62/320; 241/194; 241/DIG. 17
(58) Field of Search ..... 62/320; 241/194, 241/DIG. 17

(56) References Cited

U.S. PATENT DOCUMENTS

| | | | | | |
|---|---|---|---|---|---|
| 3,878,995 | A | * | 4/1975 | Nash | 241/194 |
| 4,136,833 | A | * | 1/1979 | Knight | 241/194 |
| 4,345,439 | A | * | 8/1982 | Gundlach | 62/320 |
| 4,547,076 | A | * | 10/1985 | Maurer | 62/320 |
| 4,745,773 | A | * | 5/1988 | Ando | 62/320 |
| 5,687,919 | A | * | 11/1997 | Cory | 241/DIG. 17 |

FOREIGN PATENT DOCUMENTS

| | | |
|---|---|---|
| JP | P2000-18783 | 1/2000 |

* cited by examiner

*Primary Examiner*—William E. Tapolcai
(74) *Attorney, Agent, or Firm*—Armstrong, Westerman, Hattori, McLeland & Naughton, LLP.

(57) ABSTRACT

Artificial snow making equipment includes an air-blowing pulverizer which prevents fluctuation in the size of ice pieces by eliminating fluctuation in the amount of ice blocks being supplied also eliminates blocking by the ice blocks, as a result utilizing air effectively such that the ice pieces are blown out as artificial snow the requisite distance. The artificial snow making equipment with constant forced blowing includes ice block supplier 1 to supply ice blocks at a constant rate and air-blowing pulverizer 11. The ice block supplier 1 has ice block supply opening 4 through which ice blocks 2 are supplied, casing 3 which has ice block supply opening 4; rotary blades 8 which supply ice blocks 2 at a constant rate while rotating in casing 3; and exit for ice blocks 5 which is positioned under casing 3. The air-blowing pulverizer 11 has air duct 9 which receives air 12 as well as ice blocks 2 that are supplied from an ice block supplier 1; casing 13 which has opening 10 of air duct 9 on the side surface; rotary blades 17 which pulverize ice blocks 2 into ice pieces 18 and which is placed in casing 13; and air exhaust 19 which is formed on the side of casing 13 opposite from opening 10 of the air duct to blow ice pieces 18 as artificial snow 20. An exit for ice blocks 5 of an ice block supplier 1 to supply ice blocks at a constant rate is connected to ice block receiving slot 14 of air-blowing pulverizer 11 via air duct 9.

8 Claims, 11 Drawing Sheets

SNOWMAKING MACHINE

FIELD OF THE INVENTION

The present invention relates to an artificial snow making equipment for an artificial ski slope wherein a block of ice is pulverized and blown away.

RELATED ART

A conventional air-blowing pulverizer such as an ice crusher generates artificial snow 49 by pulverizing ice block 48 into sleet-like small pieces as shown in FIGS. 11 and 12. The equipment in FIG. 11 has rotary blades 45 for pulverizing which are arranged at an equal distance from each other in the radial direction around the rotational shaft in casing 44 on the top of rigid substrate 47. Air supply opening 41, through which air to glow artificial snow 49 is supplied, and ice supply opening 42, through which ice blocks are supplied, are placed at one end of substrate 47 under the lower end of casing 44. The other end of substrate 47 under casing 44, opposite from supply opening 42, has exhaust opening 43 through which artificial snow 49 made of pulverized ice is blown. Ice blocks 48 are supplied, together with air through air supply opening 41 on the substrate at the right side in the figure and are pulverized into sleet-like pieces by crushing them against substrate 47 with the rotational force of rotary blades 45, which are arranged around rotational shaft 46 and rotate at Another example of a conventional air-blowing pulverizer is shown in FIG. 12. Herein, the positions of supply opening 42 for ice blocks and air supply opening 41 are different from ones in FIG. 11 wherein they are arranged at separate positions on casing 44. Supply opening 42 for ice blocks 48 is placed at the top of casing 44. Supplied ice blocks, while passing through casing 44 by rotary blades 45 for pulverizing which are rotated by rotational shaft 46 at a high speed, are crushed with rotary blades 45 and reach the air supply opening at the bottom of casing 44. The crushed ice is further pulverized between substrate 47 and rotary blades 45 to be artificial snow 49 which is blown with air through exhaust opening 43 at the other end of the bottom of casing 44.

However, the above air-blowing pulverizer has drawbacks. With the pulverizer of FIG. 11, the size of ice pieces pulverized by rotary blades 45 may vary depending on the amount of ice blocks 48 supplied to casing 44 through supply opening. Also, once the supply of ice blocks 48 becomes excessive, the path between air supply opening 41 and exhaust opening 43 may become blocked with snow. Therefore, excess drive is required to rotate rotary blades 45 at a high speed. With the pulverized of FIG. 12, in addition to the drawbacks discussed about the pulverizer in FIG. 11, when one intensifies the air flow through air supply opening 41 to blow the pulverized ice pieces further, not all the air reaches exhaust opening 43, but some air flows backward and tends to leak from supply opening 42. As a result, the air flow to blow artificial snow 49 from exhaust opening 43 is weakened such that artificial snow 49 cannot be blown far enough. Consequently, further drive is required.

Hence, the present invention intends to provide an efficient air-blowing pulverizer in which:

- variance in the size of pulverized ice pieces is eliminated by stabilizing the amount of ice blocks to be supplied such that the resulting artificial snow is more desirable for skiing;
- operation of the pulverizer is smoothly continued by preventing ice blocks from blocking inside the casing; and
- all supplied air can be utilized to blow the pulverized ice pieces far enough without requiring excess drive.

DESCRIPTION OF THE INVENTION

To serve the above purpose, the present invention provides, according to the first invention, an artificial snow making equipment with constant forced-blowing, comprising:

- an ice block supplier 1 to supply ice blocks at a constant rate including:
  - a casing 3 having, on a upper side of the casing, an ice block supply opening 4 through which ice blocks 2 are supplied, and on a lower side of the casing, an exit for ice blocks 5 which is positioned under the casing 3;
  - a rotary blades 8 which are arranged at an equal distance from each other around a rotational shaft 6, formed at the center of the casing 3, to supply the ice blocks 2 at a constant rate; and
- an air-blowing pulverizer 11 including:
  - an air duct 9 which receives the ice blocks 2 and air 12 being supplied from an ice block supplier 1;
  - a casing 13 having an opening 10 of the air duct 9 on the side surface;
  - rotary blades 17 radially arranged at an equal distance from each other around periphery 16 of rotational shaft 15, formed at the center of the casing 13, to pulverize ice blocks 2 into ice pieces 18; and
  - an air exhaust 19 formed on the opposite side of the casing 13 from the opening 10 of the air duct to blow ice pieces 18 as artificial snow 20,
- wherein the exit for ice blocks 5 of the ice block supplier 1 is connected to an ice block receiving slot 14 of air-blowing pulverizer 11 by the air duct 9.

According to the second invention in reference to artificial snow making equipment with constant forced-blowing of the first invention, the ice block supplier 1 is such that space 22 between the periphery of casing 3 and edge 21 of rotary blade 8 is formed to be very narrow to prevent a back flow of air 12 from exit for ice blocks 5 into the ice block supplier 1.

According to the third invention in reference to artificial snow making equipment with constant forced-blowing of the first or second invention, the rotary blades 17 of the air-blowing pulverizer 11 have width 24 equal to the length 23 of rotational shaft 15, and the rotary blades 17 are radially arranged at an equal distance from each other around the periphery 16 of the rotational shaft such that rotary blades 17 are parallel to axis 39.

According to the fourth invention in reference to artificial snow making equipment with constant forced-blowing of the first or second invention, the rotary blades 17 in the air-blowing pulverizer 11 are radially arranged in two rows at an equal distance from each other around the periphery 16 of the rotational shaft, wherein one side of the rotary blades 17, at the central periphery 26 of the shaft, is positioned behind the other side of the rotary blade 17, on an edge 25 of the shaft, in the direction opposite from direction of rotation 27 such that rotary blade 17 is oblique to axis 39.

According to the fifth invention in reference to artificial snow making equipment with constant forced-blowing of the second or fourth invention, edge portion 31 is a portion of rotary blade 17 in air-blowing pulverizer 11 between edge 29 of the blade and bending line 30 which is located between base 28 and edge 29 of the blade wherein edge portion 31 is bent in the direction opposite from direction or rotation 27.

In other words, the means of the present invention has an ice block supplier 1 to supply ice blocks as a raw material at a constant rate to air-blowing pulverizer 11. In this an ice block supplier 1, a plurality of rotary blades 8 are arranged at an equal distance from each other around rotational shaft 6 which rotates inside casing 3. Exit for ice blocks 5 of an ice block supplier 1 to supply ice blocks at a constant rate is placed facing air duct 9 through which air is forced to air-blowing pulverizer 11 such that ice blocks can be supplied to air-blowing pulverizer 11 at a constant rate by adjusting the speed of rotation of rotary blades 8 in relation to the volume of the space between rotary blades 8. Additionally, space 22 between the [inner] periphery of casing 3 and edge 21 of rotary blade 8 is established to be a minimum yet does not cause any disturbance in the rotation of rotary blades 8. This configuration prevents the force of air to air-blowing pulverizer 11 from declining, which is caused by a backflow of air to be supplied to air-blowing pulverizer 11 into ice block supplier 8 to supply ice blocks at a constant rate via exit for ice blocks 5 of an ice block supplier 1 as an opening to supply ice blocks to air-blowing pulverizer 11.

In air-blowing pulverizer 11, a plurality of rotary blades 17 are arranged in the radial direction around rotational shaft 15 which rotates in cylindrical casing 13 at a high speed. Air duct 9 is placed facing the side of casing 13 to form ice block receiving slot 14 which receives ice blocks 2 to be pulverized, as well as forced air. The side of casing 13 opposite from ice block receiving slot 14 is air exhaust 19 through which artificial snow made of pulverized ice pieces 18 is blown out.

In the case of air-blowing pulverizer 11 where rotary blades 17 are alternated in two rows around rotational shaft 15, blade 32 is positioned between one edge 25 of rotational shaft 15 and central periphery 26 of the shaft while blade 33 is positioned between central periphery 26 and the other edge 25. This plurality of blades is alternated in two rows on periphery 16 of the rotational shaft. As a result, ice blocks 2 to be pulverized move between rotary blades 17 from left to right and vice versa as they are transferred to air exhaust 19 such that ice pieces 18 will not block the space between rotary blades 17. This configuration does not require extra drive [as a counter force against the blocked path]. Further, ice blocks 2 are pulverized by rotary blades 17 while moving between rotary blades 17, resulting in more uniformed small ice pieces 18 as artificial snow 20, more appropriate for skiing. Moreover, the side of rotary blades 17 in two rows at central periphery 26 of the shaft is positioned to form an angle alpha in relation to rotational shaft 15 in the direction opposite from the direction of rotation. Consequently, ice blocks 2 can more easily move between two rows of rotary blades 17 such that the pulverizing performance is improved. Additionally, a backflow of the air in casing 13, which would cause a decline in the air pressure, is prevented such that artificial snow 20 can be blow further away.

BRIEF DESCRIPTIONS OF DRAWINGS

In these figures, following symbols are used:

1: ice block supplier to supply ice blocks at a constant rate;
2: ice blocks;
3: casing;
4: ice block supply opening;
5: exit for ice blocks;
6: rotational shaft;
7: periphery of rotational shaft;
8: rotary blades;
9: air duct;
10: opening of air duct;
11: air-blowing pulverizer;
12: air;
13: casing;
14: ice block receiving slot;
15: rotational shaft;
16: periphery of rotational shaft;
17: rotary blades;
18: ice pieces;
19: air exhaust;
20: artificial snow;
21: edge;
22: space;
23: length of shaft;
24: width;
25: edge of shaft;
26: central periphery of shaft;
27: direction of rotation;
28: base of rotary blade;
29: edge of rotary blade;
30: bending line;
31: edge portion of rotary blade
32–38: blade;
39: axis;
40: shifting direction;
41: air supply opening
42: ice supply opening;
43: exhaust opening;
44: casing;
45: rotary blades
46: rotational shaft;
47: substrate;
48: ice blocks;
49: artificial snow
50: angle alpha;
51: angle beta;

EMBODIMENTS

Figure 1:
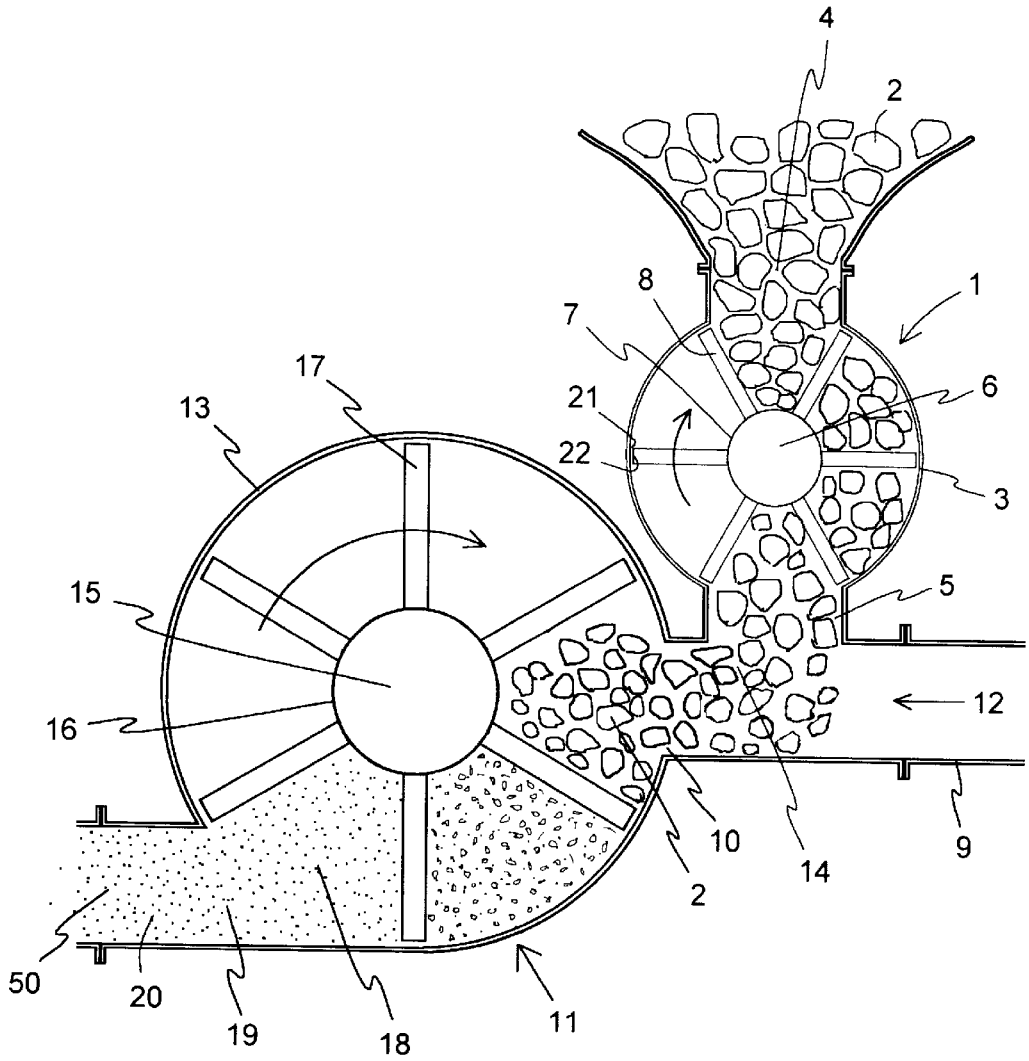
FIG. 1 is a schematic configuration showing artificial snow making equipment with constant forced blowing of the present invention.

The following describes embodiments of the present invention in reference to the drawings. FIG. 1 is a schematic configuration of the present invention showing artificial snow making equipment with constant forced blowing wherein the front wall is removed to show the inside configuration. Number 1 is an ice block supplier to supply ice blocks at a constant rate, placed on the upstream side of air-blowing pulverizer 11. An ice block supplier 1 to supply ice blocks at a constant rate has funnel-shaped ice block supply opening 4, which receives ice blocks 2 as a raw material, on the top of steel cylindrical casing 3. In casing 3, rotational shaft 6 is positioned at the center and is rotated by a drive (not show in the figure) in the direction indicated by an arrow. With rotary blades 8 comprised of six steel blades, the width of each blade is equal to the width of rotational shaft. Additionally, the blades reach the inner wall of casing 3 and are arranged at an equal distance from each other in the radial direction around periphery 7 of rotational shaft 6. Exit for ice blocks 5, having a width equal to the distance between blades, is positioned at the bottom of casing 3.

Exit for ice blocks 5 of an ice block supplier 1 to supply ice blocks at a constant rate is connected to the side of air duct 9 through which air 12 is sent into air-blowing pulverizer 11 at the bottom of an ice block supplier 1 and functions as ice block receiving slot 14 of air-blowing pulverizer 11. After obtaining ice blocks 2 through ice block receiving slot 14, ice blocks are transferred together with air 12 via air duct 9 through opening 10 of air duct, connected to the side of cylindrical steel casing 13, into air-blowing pulverizer 11. Rotational shaft 15 is placed at the center of casing 13 and is driven by a drive (not shown in the figure) at a high speed in the direction indicated by the arrow. Rotary blades 17 composed of steel are arranged at an equal distance around periphery 16 of rotational shaft 15 in the radial direction. Air exhaust 19, through which ice pieces 18 pulverized in casing 13 are blown with forced air as artificial snow, is placed at the side of casing 13 opposite from opening 10 of the air duct.

In an ice block supplier 1 to supply ice blocks at a constant rate, space 22 between edge 21 of rotary blades 8 and the inside wall of casing 13 is established to be a minimum without disturbing the rotation of the blades. As a result, air 12 is prevented from flowing from exit for ice blocks 5 to an ice block supplier 1 via space 22.

Figure 2:
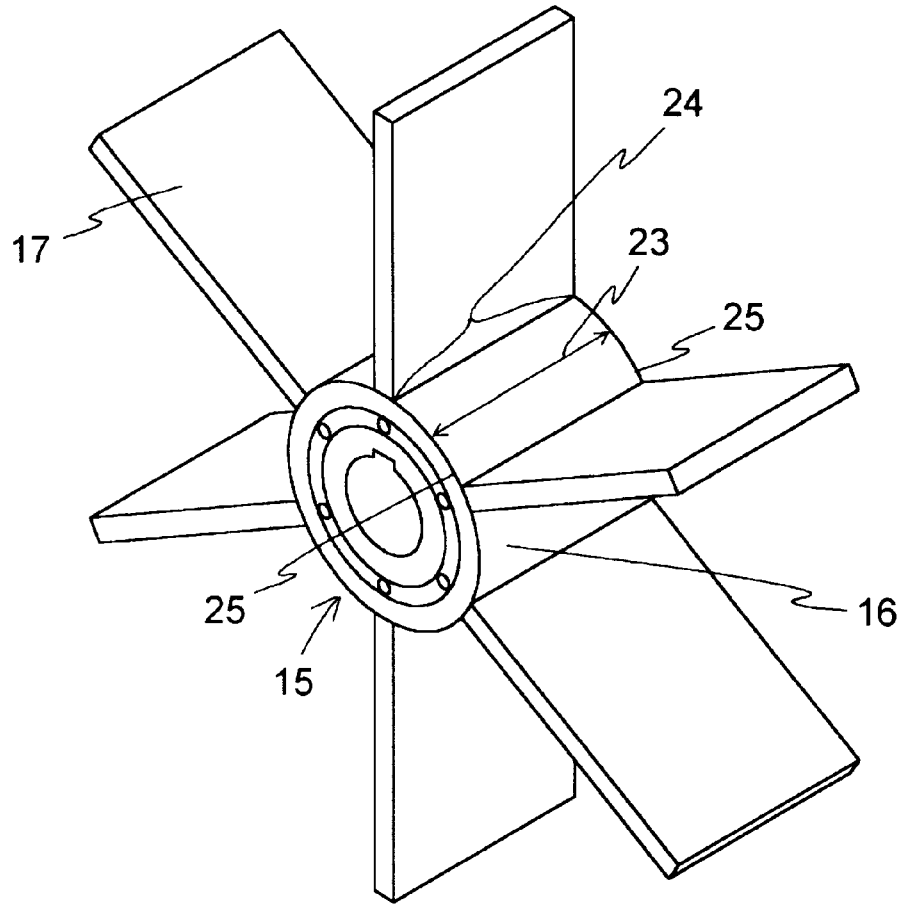
FIG. 2 is an oblique view of one row of rotary blades in an air-blowing pulverizer according to the present invention.

There are various modifications of rotary blades 17 of air-blowing pulverizer 11. The following describes those modifications in reference to drawings of rotary blades 17. FIG. 2 illustrates rotary blades 17 that have width 24 equal to length 23, between edge 25 and another edge 25 of rotational shaft 15 wherein six rotary blades 17 are arranged at an equal distance from each other around periphery 16 of rotary shaft 15 in parallel to axis 39. In this case, ice blocks 2, which are supplied from opening 10 of the air sending duct on the side of casing 13, are pulverized by being crushed by one of rotary blades 17 in rotation. The ice blocks are further pulverized by friction against each other to become ice pieces 18. Ice pieces 18 are pushed by rotary blades 17 during the rotation and blown out through air exhaust 19.

Figure 3:
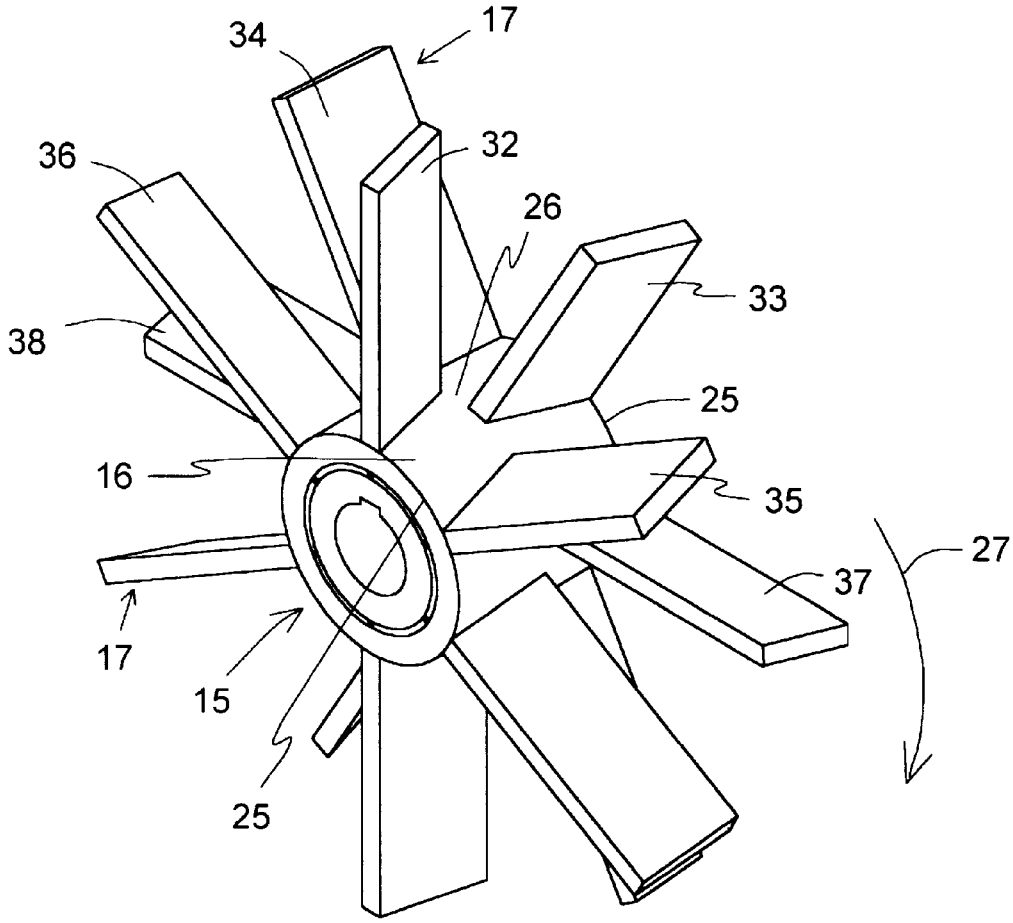
FIG. 3 is an oblique view of two rows of rotary blades in an embodiment of the present invention.

The following describes rotary blades 17 of another embodiment in reference to FIG. 3. Two rows of rotary blades, which have a width equal to the distance from one edge 25 of the shaft to central periphery 26 of the shaft, are arranged at an equal distance from each other in parallel to axis 39 wherein positions of rotary blades 17 in the left row and the right row are alternated. Herein, rotary blade 17 is not adjacent to the center of another rotary blade 17 on periphery 16. Therefore, ice blocks 2, which are inserted from opening 10 of the air duct on the side of casing 13, are placed in front of rotating rotary blade 17 and crushed therewith. Ice blocks 2 are then pushed by rotary blade 17 to the space on periphery 16 of the shaft in the adjacent row. Accordingly, ice blocks shift between rotary blades 17 in the left and right rows during the rotation such that the ice blocks are further pulverized by the blades. Together with pulverization due to the friction among the ice blocks, ice pieces 18 with uniform small particles result.

Figure 4:
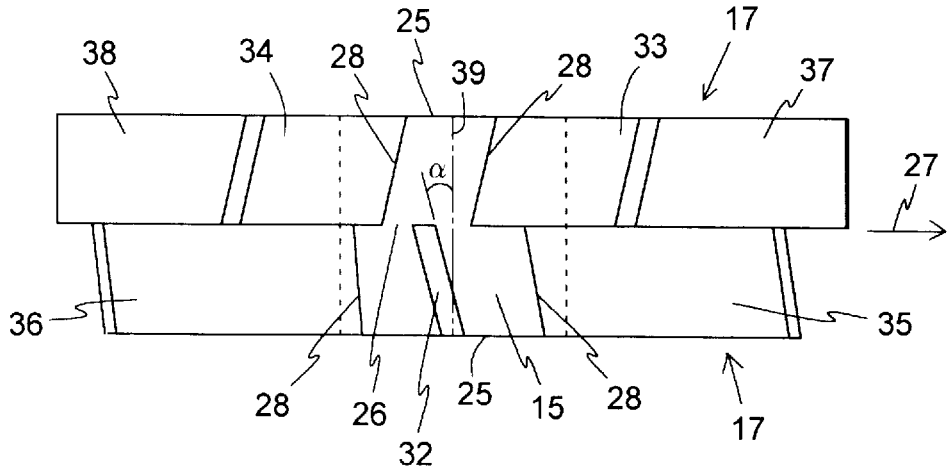
FIG. 4 is a plan view of the rotary blades in FIG. 3.
Figure 5:
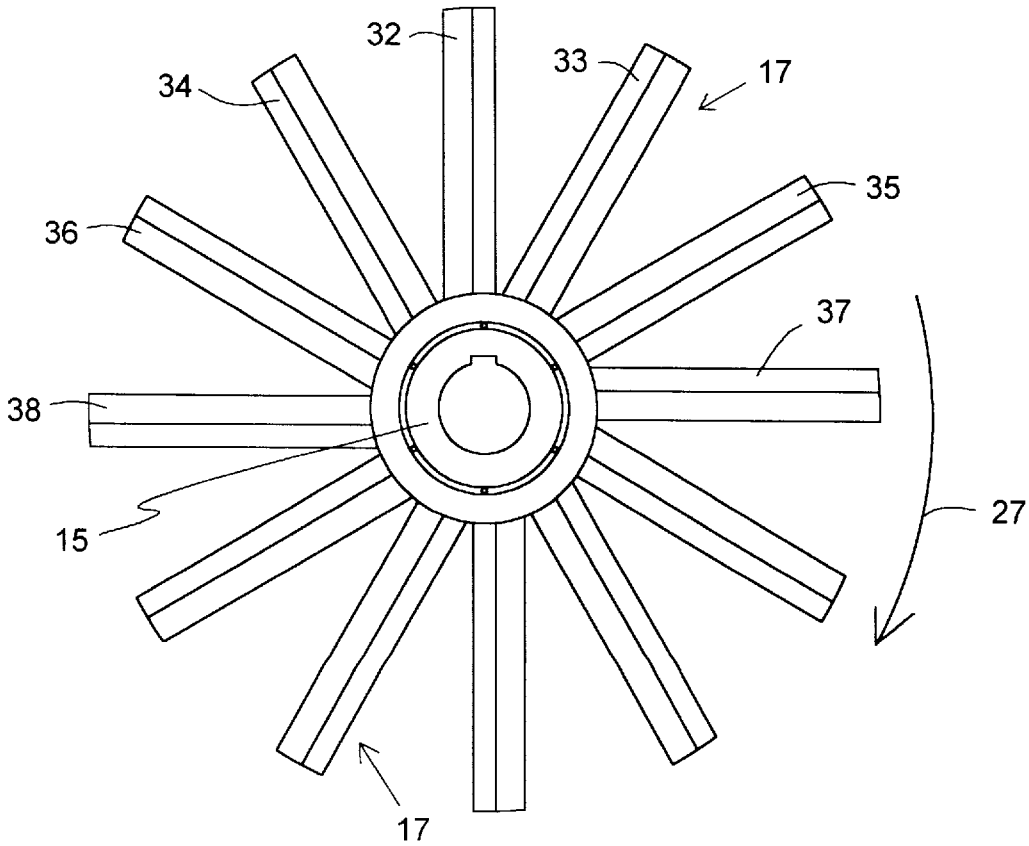
FIG. 5 is an profile view of FIG. 3.
Figure 6:
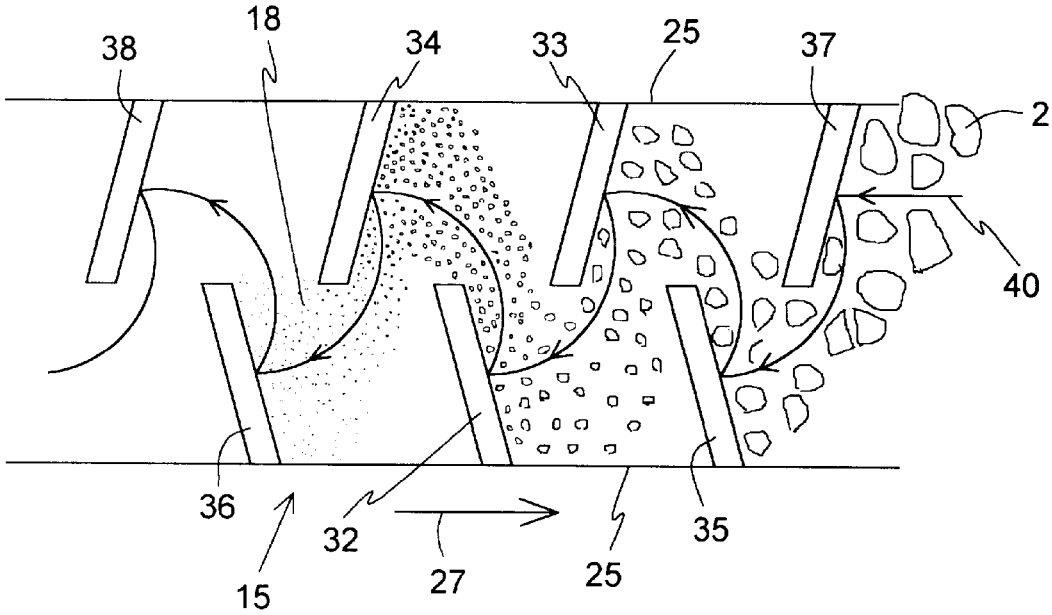
FIG. 6 is an expanded plan view of a rotational shaft and rotary blades.

FIGS. 3 through 6 show rotary blades 17 of yet another embodiment. Herein, the center sections of rotary blades 17 in two rows are shifted backward in relation to the sides on edges 25 of the shaft in the direction opposite from the direction of rotation 27 with angle alpha in relation to axis 39 of rotational shaft 15 while rotary blades 17 of two rows are arranged parallel to axis 39 in the above embodiment. FIG. 4 is a plan view of rotary blades 17 in FIG. 3 while FIG. 5 is an profile view of rotary blades 17 in FIG. 3. A dotted line in FIG. 4 indicates rotational shaft 15. In FIG. 5, blades 32, 35 and 36 are positioned on the closer side of rotary shaft 15 as shown in FIG. 3 wherein the side of the blades at central periphery 26 is shifted backward in relation to the side of edge 25 with angle alpha in relation to axis 39. Similarly, blades 33, 34, 37 and 38 are positioned on the further side of rotary shaft 15 wherein the side of the blades at central periphery 26 is shifted backward in relation to the side of edge 25 with angle alpha in relation to axis 39. Blades on either side are angled at the center section in the direction opposite from direction of rotation 27. FIG. 6 is an expanded plan view of rotational shaft 25 and rotary blades 17.

When rotary blades 17 of FIG. 5 rotate in the direction of rotation 27 as in FIG. 6, ice blocks 2 shift between the blades in two rows (top and bottom rows in the figure) in shifting direction 40, as indicated with an arrow. Ice blocks 2 are crushed by the blades every time they are shifted therebetween, resulting in ice pieces 18 which move in the direction of rotation 27 and are blown out from air exhaust 19. In other words, after being crushed by blade 37, ice blocks 2 shift along the arrow and are further pulverized by blade 35. The pulverized ice blocks are shifted to blade 33, then blade 32 to be further pulverized resulting in ice pieces 18 which moves in shifting direction 27 and are blown out from air exhaust 19.

Figure 7:
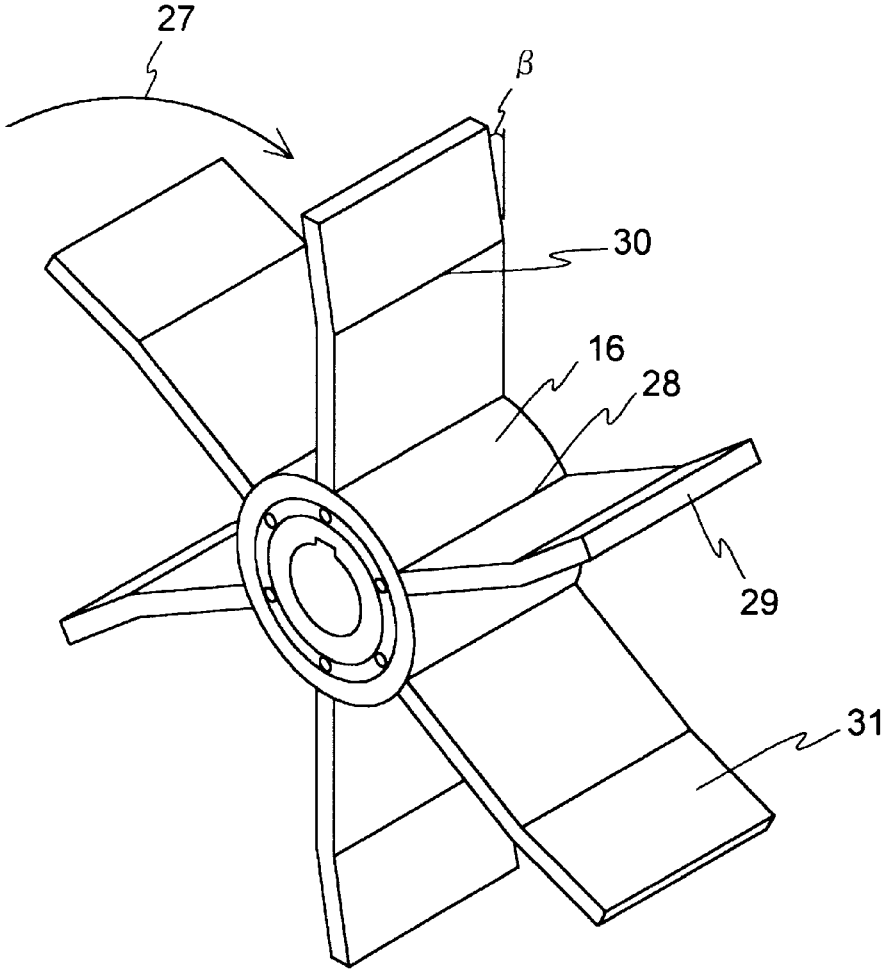
FIG. 7 is an oblique view of another embodiment of FIG. 2 wherein the edge portion of the rotary blades are bent.
Figure 8:
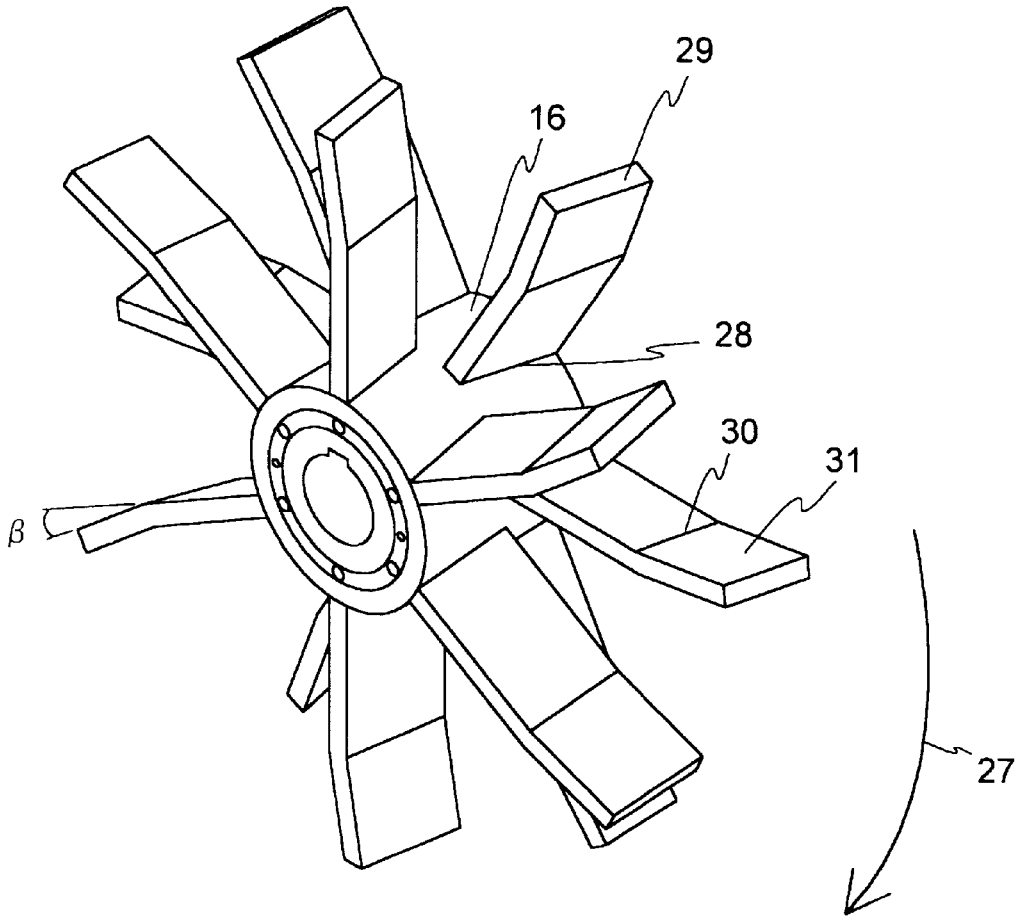
FIG. 8 is an oblique view of another embodiment of FIG. 3 wherein the edge portion of the rotary blades are bent.
Figure 9:
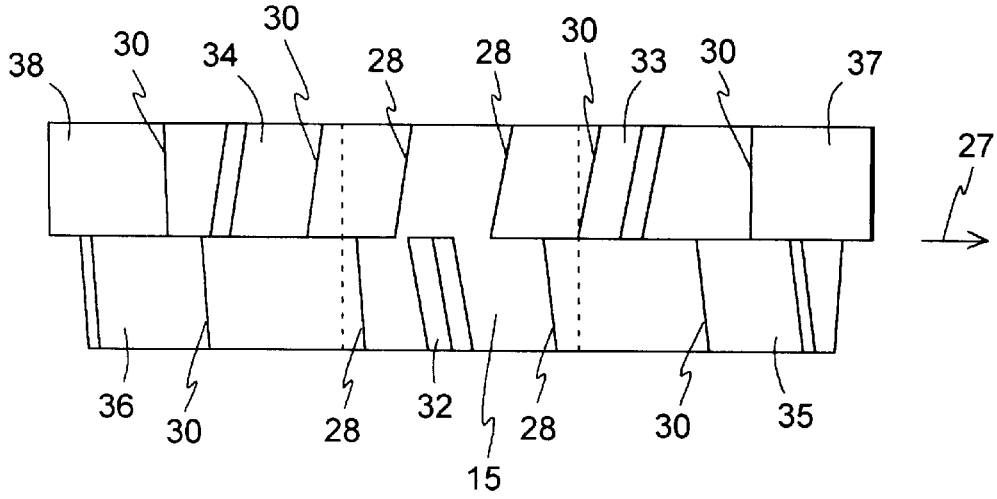
FIG. 9 is a plan view of the rotary blades in FIG. 7.
Figure 10:
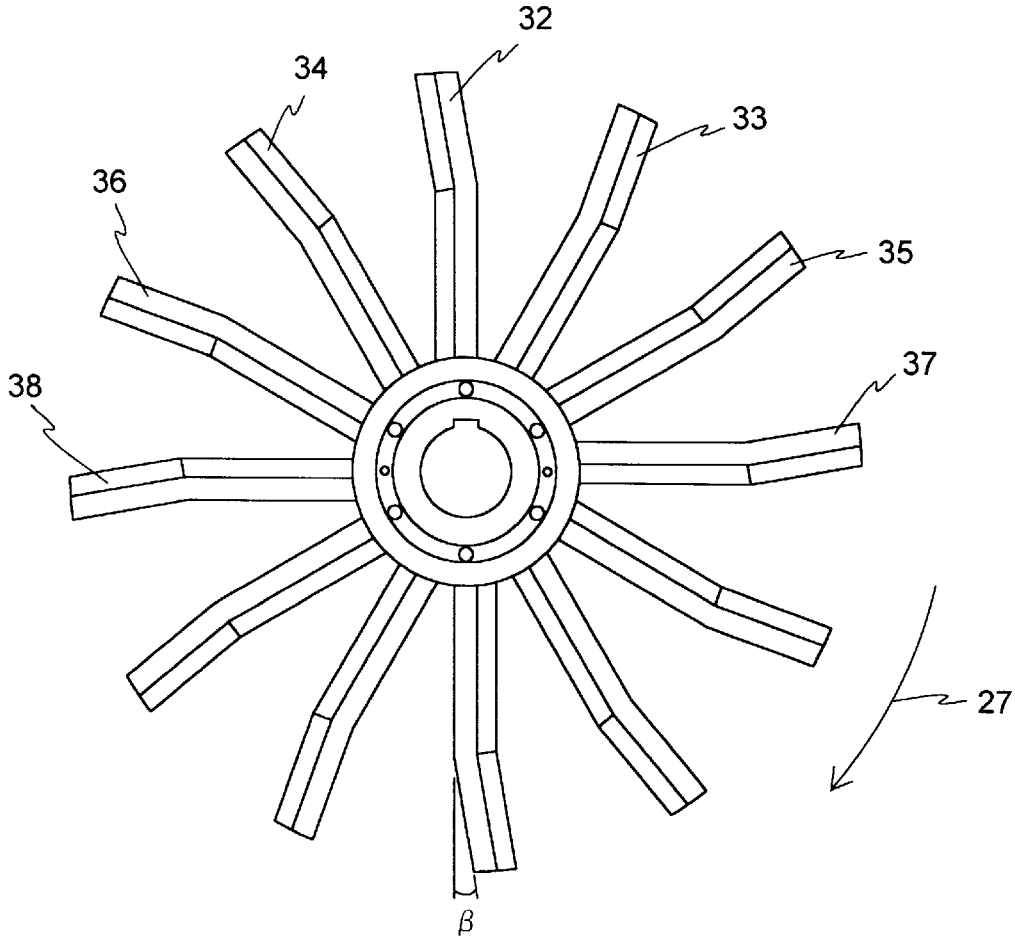
FIG. 10 is an profile view of the rotary blades in FIG. 7.
Figure 11:
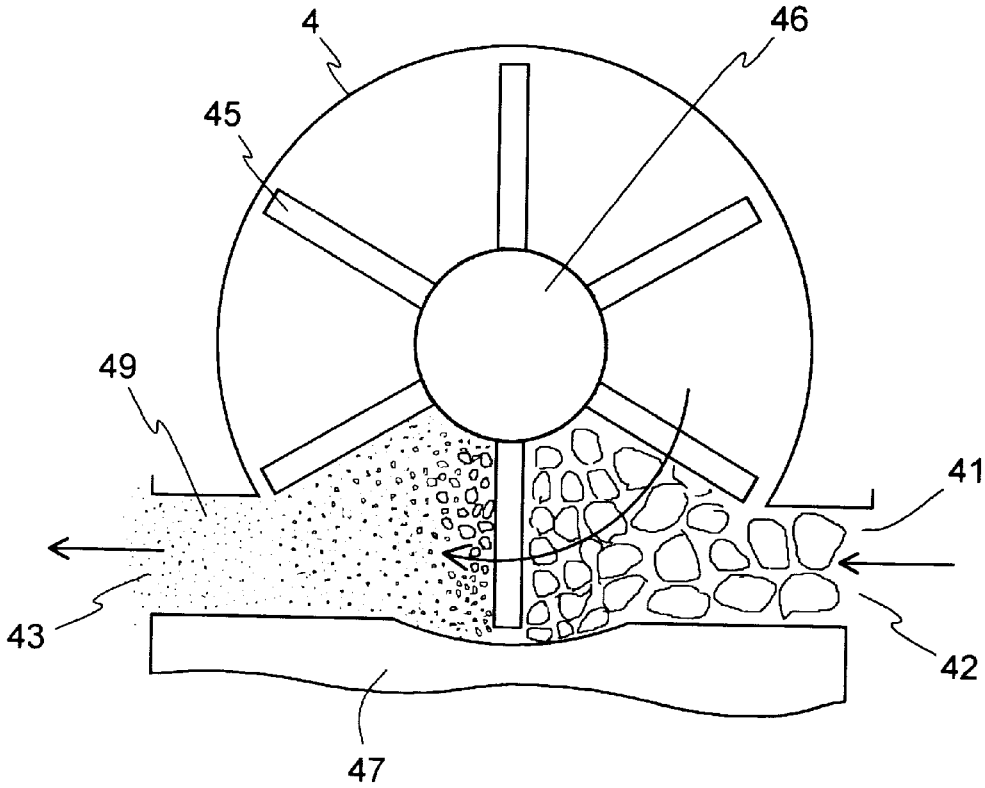
FIG. 11 is a side view of a schematic configuration of conventional air-blowing artificial snow making equipment.
Figure 12:
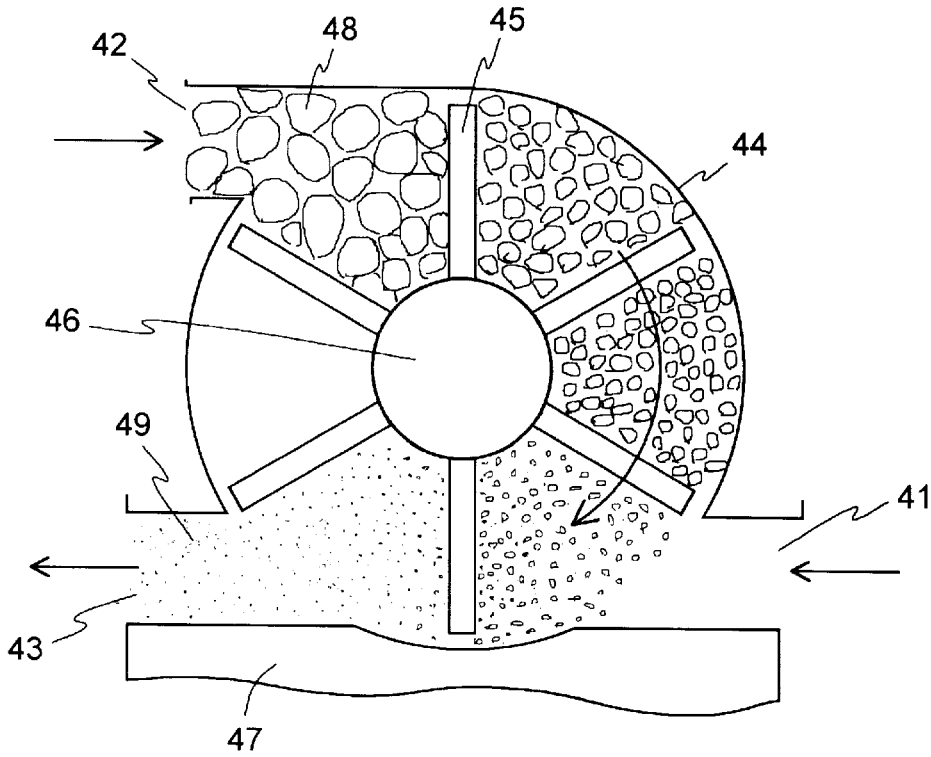
FIG. 12 is a side view of a schematic configuration of another conventional air-blowing artificial snow making equipment.

Yet another embodiment is shown in FIGS. 7 through 10. FIG. 7 is a modification of rotary blades 17 of FIG. 2. FIG. 8 is a modification of rotary blades 17 in two rows of FIG. 3. In these embodiments, bending line 30 is established from base 28 to edge 29 of rotary blade 17 wherein edge section 31 of rotary blade 17 nearest the edge is bent at bending line 30 with angle beta in direction of rotation 27. FIG. 9 is a plan view of the rotary blades of FIG. 7 while FIG. 10 is an profile view of FIG. 7. By bending edge portion 31 of the rotary blades in direction of rotation 27, ice blocks 2 supplied from opening 10 of the air duct into air-blowing pulverizer 11 are crushed by rotary blades 17 with more force to produce finer ice pieces 18. As a result, artificial snow 20, which is more suitable for skiing, can be obtained.

The following further describes the artificial snow making equipment and its operation. Ice blocks to be used with an ice block supplier 1 to supply ice blocks at a constant rate are plate ice prepared with an ice machine in advance and have a size of 7 mm thickness×50 mm×100 mm. The speed of rotation of rotary blades 8 in an ice block supplier 1 is established at 25 rpm such that the ice blocks are supplied to air-blowing pulverizer 11 together with forced air from air duct 9. The force of the forced air from air duct 9 is established to be strong enough to blow out artificial snow 20 made of ice pieces 18, which are pulverized with air-blowing pulverizer 11, through air exhaust 19 at the wind speed of 30 m/sec. In other words, the speed of rotation of rotary blades 17 of air-blowing pulverizer 11 is established to be a high speed of 1500 to 1600 rpm. The performance of air-blowing pulverizer 11 to process artificial snow 20 is 20 $m^3$/min. Additionally, rotary blades 17 in two rows between edge 25 of the shaft and central periphery 26 of the shaft are angled in relation to axis 39 by 10 to 15 degree. The diameter of rotary blades 17 of air-blowing pulverizer 11 is 700 mm, and length 23 is 190 mm. In the case of rotary blades 17 which have their edge 31 bent at bending line 30, the radius between the center of the shaft to bending line 30 of the rotary blades 17 is established to be 250 mm. In addition, the number of rotary blades 17 in each row on the shaft periphery is 6. The size of ice pieces 18 produced by air-blowing pulverizer 11 is sleet-like ice used for snow-cones. Ice pieces 18 are blown out through a hose of about 50 m at air exhaust 19 of air-blowing pulverizer 11 onto a ski slope as artificial snow 20.

Application in the Field

As described above, the present invention of the artificial snow making equipment with constant forced blowing has an ice block supplier which supplies ice blocks to an air-blowing pulverizer at a constant rate at the upstream of the air-blowing pulverizer. As a result, pulverization by rotary blades of the air-blowing pulverizer is uniformly performed such that the size of pulverized ice pieces is uniform. Additionally, ice blocks are supplied at a constant rate, preventing any blocking of the space between the rotary blades due to excess supply, such that a sudden stop of the air-blowing pulverizer is preventable. Further, any excess drive is not required to rotate the rotary blades against the force. In addition, a decline in the force of air, due to a back flow of forced air into the ice block supplier to supply ice blocks at a constant rate, can be prevented. In the air-blowing pulverizer, an ice block supply opening is placed to connect to an opening of an air duct. Therefore, the air, forced together with ice blocks from the opening of the air duct, is used only for blowing the artificial snow through the air exhaust. Consequently, a loss in air-pressure is minimized such that the artificial snow can be blown to the requisite distance. Additionally, two rows of the rotary blades are alternated around a rotational shaft such that ice blocks are strongly pulverized by a plurality of rotary blades while shifting between the alternated rotary blades, resulting in high pulverization performance. Hence, a large amount of excellent artificial snow with uniform particles can be produced. Further, the rotary blades are angled in relation to the axis of the rotational shaft such that the center side of the rotary blades are shifted backward such that the ice blocks can be shifted among the rotary blades more smoothly. As a result, the ice blocks are efficiently crushed by the rotary blades which increases the pulverization performance. Moreover, since the edge of the blades are bent in the direction of rotation, the blades can pulverize the ice blocks with more force. Therefore, finer and more uniformed ice pieces can be effectively produced. These effects are not obtained by conventional technology.

We claim:

1. An artificial snow making equipment with constant forced-blowing, comprising:

an ice block supplier (1) to supply ice blocks at a constant rate including:

a first casing (3) having, on a upper side of the casing, an ice block supply opening (4) through which ice blocks (2) are supplied, and on a lower side of the casing, an exit for ice blocks (5) which is positioned under the first casing (3);

a rotary blades (8) which are arranged at an equal distance from each other around a rotational shaft (6), formed at the center of the first casing (3), to supply the ice blocks (2) at a constant rate; and an air-blowing pulverizer (11) including:

an air duct (9) which receives air (12) and the ice blocks (2) being supplied from the ice block supplier (1);

a second casing (13) having an opening (10) of the air duct (9) on the side surface;

rotary blades (17) radially arranged at an equal distance from each other around periphery (16) of rotational shaft (15), formed at the center of the second casing (13), to pulverize ice blocks (2) into ice pieces (18); and an air exhaust (19) formed on the opposite side of the second casing (13) from the opening (10) of the air duct to blow ice pieces (18) as artificial snow (20), wherein the exit for ice blocks (5) of the ice block supplier (1) is connected to an ice block receiving slot (14) of air-blowing pulverizer (11) by the air duct (9).

2. The artificial snow making equipment with constant forced-blowing according to claim 1, wherein the ice block supplier (1) is such that space (22) between the inner periphery of casing (3) and edge (21) of rotary blade (8) is formed to be very narrow to prevent a back flow of air (12) from the exit for ice blocks (5) into the ice block supplier (1).

3. The artificial snow making equipment with constant forced-blowing according to claim 2, wherein the rotary blades (17) of the air-blowing pulverizer (11) have width (24) equal to the length (23) of rotational shaft (15), and the rotary blades (17) are radially arranged at an equal distance from each other around the periphery (16) of the rotational shaft such that rotary blades (17) are parallel to axis (39).

4. The artificial snow making equipment with constant forced-blowing according to claim 2, wherein the rotary blades (17) in the air-blowing pulverizer (11) are radially arranged in two rows at an equal distance from each other around the periphery (16) of the rotational shaft, wherein one side of the rotary blades (17), at the central periphery (26) of the shaft, is positioned behind the other side of the rotary blade (17), on an edge (25) of the shaft, in the direction opposite from direction of rotation (27) such that rotary blade (17) is oblique to axis (39).

5. The artificial snow making equipment with constant forced-blowing according to claim 4, in which edge portion (31) is a portion of rotary blade (17) in air-blowing pulverizer (11) between edge (29) of the blade and bending line (30) which is located between base (28) and edge (29) of the blade wherein edge portion (31) is bent in the direction opposite from direction or rotation (27).

6. The artificial snow making equipment with constant forced-blowing according to claim 1, wherein the rotary blades (17) of the air-blowing pulverizer (11) have width (24) equal to the length (23) of rotational shaft (15), and the rotary blades (17) are radially arranged at an equal distance from each other around the periphery (16) of the rotational shaft such that rotary blades (17) are parallel to axis (39).

7. The artificial snow making equipment with constant forced-blowing according to claim 1, wherein the rotary blades (17) in the air-blowing pulverizer (11) are radially arranged in two rows at an equal distance from each other around the periphery (16) of the rotational shaft, wherein one side of the rotary blades (17), at the central periphery (26) of the shaft, is positioned behind the other side of the rotary blade (17), on an edge (25) of the shaft, in the direction opposite from direction of rotation (27) such that rotary blade (17) is oblique to axis (39).

8. The artificial snow making equipment with constant forced-blowing according to claim 3, in which edge portion (31) is a portion of rotary blade (17) in air-blowing pulverizer (11) between edge (29) of the blade and bending line (30) which is located between base (28) and edge (29) of the blade wherein edge portion (31) is bent in the direction opposite from direction or rotation (27).

* * * * *